US009111474B2

(12) United States Patent
Ooki et al.

(10) Patent No.: US 9,111,474 B2
(45) Date of Patent: Aug. 18, 2015

(54) DISPLAY DEVICE

(71) Applicant: Japan Display Inc., Tokyo (JP)

(72) Inventors: Youichi Ooki, Mobara (JP); Yoshihiro Kotani, Chiba (JP)

(73) Assignee: JAPAN DISPLAY INC., Tokyo (JP)

( * ) Notice: Subject to any disclaimer, the term of this patent is extended or adjusted under 35 U.S.C. 154(b) by 203 days.

(21) Appl. No.: 13/629,813

(22) Filed: Sep. 28, 2012

(65) Prior Publication Data

US 2013/0141410 A1 Jun. 6, 2013

(30) Foreign Application Priority Data

Sep. 30, 2011 (JP) ..... 2011-216150

(51) Int. Cl.
*G09G 5/00* (2006.01)
*G09G 3/36* (2006.01)

(52) U.S. Cl.
CPC ..... *G09G 5/001* (2013.01); *G09G 3/3611* (2013.01); *G09G 2370/04* (2013.01); *G09G 2370/14* (2013.01)

(58) Field of Classification Search
CPC ..... G09G 2370/04; G09G 2370/14; G09G 3/3611; G09G 5/001
USPC ..... 345/100, 213, 211
See application file for complete search history.

(56) References Cited

U.S. PATENT DOCUMENTS

2005/0168429 A1 8/2005 Chou
2005/0219189 A1 10/2005 Fukuo
2008/0266019 A1* 10/2008 Fusayasu et al. ..... 333/12
2010/0315887 A1* 12/2010 Park ..... 365/189.07
2011/0063270 A1* 3/2011 Minami ..... 345/208

FOREIGN PATENT DOCUMENTS

CN 102024408 4/2011

OTHER PUBLICATIONS

Partial English Translation of the Office Action for Chinese Patent Appln No. 201210377401.X , dated Apr. 23, 2014 (4 pgs.).
Office Action issued by Chinese Patent Office on Jan. 4, 2015 regarding a counterpart Chinese patent application No. 201210377401.X.

* cited by examiner

*Primary Examiner* — Quan-Zhen Wang
*Assistant Examiner* — Tony Davis
(74) *Attorney, Agent, or Firm* — Lowe Hauptman & Ham, LLP

(57) ABSTRACT

A method of terminating a pair of transmission lines is changed over by terminal setting. Display data is supplied to a master drive circuit and (n−1)-pieces of drive circuits from a host computer via the pair of transmission lines in accordance with a differential serial transmission system. Each drive circuit includes an SELC terminal. When a voltage inputted to the SELC terminal is at a first voltage level, a resistor having a resistance value of Ra is connected between the pair of transmission lines in the master drive circuit thus terminating the pair of transmission lines, and the pair of transmission lines in the slave drive circuits is opened. When the voltage inputted to the SELC terminal is at a second voltage level which differs from the first voltage level, a resistor having a resistance value of (n×Ra) is connected between the pair of transmission lines.

13 Claims, 6 Drawing Sheets

DISPLAY DEVICE

CROSS-REFERENCE TO RELATED APPLICATION

The present application claims priority from Japanese application JP2011-216150 filed on Sep. 30, 2011, the content of which is hereby incorporated by reference into this application.

BACKGROUND OF THE INVENTION

1. Field of the Invention

The present invention relates to a display device, and more particularly to a technique which is effectively applicable to a display device to which an input signal is supplied to the display device via a pair of transmission lines in accordance with a differential serial transmission system.

2. Description of the Related Art

A TFT liquid crystal display device which uses thin film transistors as active elements can display an image with high definition and hence, the liquid crystal display device has been used as a display device for a television receiver set, a display for a personal computer or the like. Particularly, a miniaturized TFT liquid crystal display device has been popularly used as a display part of a mobile phone.

In general, in the liquid crystal display device, a so-called sub pixel is constituted such that, in a region surrounded by two neighboring scanning lines (also referred to as gate lines) and two neighboring video lines (also referred to as source lines or drain lines), a thin film transistor which is turned on in response to a scanning signal from the scanning line and a pixel electrode to which a video signal from the video line is supplied via the thin film transistor are formed.

A region in which a plurality of these sub pixels is formed constitutes a display region, and a peripheral region exists surrounding the display region. In the peripheral region, a drain driver (also referred to as a source driver) which supplies a video voltage (grayscale voltage) to each video line and a gate driver which supplies a scanning voltage to each scanning line are provided.

Display control signals are inputted to the drain driver and the gate driver from a display control circuit (also referred to as a timing controller) so that the drain driver and the gate driver are controlled and driven by the display control circuit.

SUMMARY OF THE INVENTION

Recently, with respect to a liquid crystal display panel for a middle-sized or miniaturized device, a technique for acquiring higher resolution has made progress, and a liquid crystal display panel having high definition of WVGA class constitutes the mainstream. However, a demand for higher definition and higher image quality never stops, and a WXGA-level liquid crystal display panel constitutes the mainstream with respect to high end models such as tablet terminals.

In view of such circumstances, to satisfy a demand for liquid crystal display panels in a broad range from a low resolution class to a high resolution class, it is desirable to change over the chip constitution between the 1-chip constitution and the plural-chip constitution such that the liquid crystal display panel of low resolution class adopts the 1-chip constitution where a liquid crystal driver uses only 1 chip, and a liquid crystal display panel of a high resolution class adopts the plural-chip constitution where a liquid crystal driver uses a plurality of chips also from a viewpoint of realizing the reduction of cost.

To satisfy such a demand, it may be possible to provide the 1-chip constitution or the plural-chip constitution based on terminals mounted on the liquid crystal driver.

In such circumstances, it is necessary to terminate a pair of transmission lines for supplying input signals in accordance with a differential serial transmission system, and it is also necessary to prevent the collision of a plurality of signals at the time of reading signals via the pair of transmission lines.

The present invention has been made to satisfy the above-mentioned demands, and it is an object of the present invention to provide a technique which can change over a method of terminating a pair of transmission lines or can prevent the collision of signals at the time of reading signals via the pair of transmission lines by performing terminal setting in a display device.

The above-mentioned and other objects and novel technical features of the present invention will become apparent from the description of this specification and attached drawings.

To briefly explain the summary of typical inventions out of inventions disclosed in this specification, they are as follows.

(1) According to one aspect of the present invention, there is provided a display device including: a plurality of pixels; and n ($n \geq 2$) pieces of drive circuits for driving the plurality of pixels, wherein display data is supplied to the respective drive circuits from a host computer via a pair of transmission lines in accordance with a differential serial transmission system, one drive circuit out of the n pieces of drive circuits is operated as a master drive circuit, each drive circuit other than the master drive circuit out of the n pieces of drive circuits is operated as a slave drive circuit, each of the drive circuits includes an SELC terminal, when a voltage inputted to the SELC terminal is at a first voltage level, a resistor having a resistance value of Ra is connected between the pair of transmission lines in the master drive circuit thus terminating the pair of transmission lines, and a resistor is not connected between the pair of transmission lines in the slave drive circuit thus opening the pair of transmission lines, and when the voltage inputted to the SELC terminal is at a second voltage level which differs from the first voltage level, a resistor having a resistance value of ($n \times Ra$) is connected between the pair of transmission lines in each of the n pieces of drive circuits thus terminating the pair of transmission lines.

(2) In the display device having the above-mentioned constitution (1), each of the drive circuits includes an SELA terminal and an SELB terminal, each of the drive circuits operates as the master drive circuit when a voltage inputted to the SELA terminal is at the second voltage level, and a voltage inputted to the SELB terminal is at the first voltage level, and each of the drive circuits operates as the slave drive circuit when the voltage inputted to the SELA terminal is at the second voltage level, and the voltage inputted to the SELB terminal is at the second voltage level.

(3) In the display device having the above-mentioned constitution (1), when n is 3 or more, each of the drive circuits includes terminals ranging from an SELD1 terminal to an SELD (n−2) terminal, and each of the slave drive circuits recognizes the order thereof in the slave drive circuits based on levels of voltages inputted to the terminals ranging from the SELD1 terminal to the SELD (n−2) terminal respectively.

(4) According to another aspect of the present invention, there is provided a display device including: a plurality of pixels; and a plurality of drive circuits for driving the plurality of pixels, wherein an input signal is supplied to each of the drive circuits from a host computer via a pair of transmission lines in accordance with a differential serial transmission system, each of the drive circuits includes an REVS terminal, and when the host computer reads a signal from each of the drive circuits, only the drive circuit where a voltage at a second voltage level is inputted to the REVS terminal transmits data to the pair of transmission lines.

(5) According to another aspect of the present invention, there is provided a display device including: a plurality of pixels; and a plurality of drive circuits for driving the plurality of pixels, wherein an input signal is supplied to each of the drive circuits from a host computer via a pair of transmission lines in accordance with a differential serial transmission system, each of the drive circuits includes a resistor, and when the host computer reads a signal from each of the drive circuits, only the drive circuit where reading permitting data is written in the resistor transmits the signal to the pair of transmission lines.

(6) In the display device having the above-mentioned constitution (5), the host computer writes the reading permitting data in the resistor in the drive circuit which is an object to be read next.

(7) In the display device having any one of the above-mentioned constitutions (1), (4) and (5), each of the drive circuits is a video line drive circuit having a display control circuit.

(8) According to another aspect of the present invention, there is provided a display device including: a plurality of pixels; n (n≥2) pieces of video line drive circuits for driving the plurality of pixels; and a display control circuit, wherein an input signal is supplied to the respective video line drive circuits from the display control circuit via a pair of transmission lines in accordance with a differential serial transmission method, each of the video line drive circuits includes an SELC terminal, when a voltage inputted to the SELC terminal is at a first voltage level, a resistor having a resistance value of Ra is connected between the pair of transmission lines in the first video line drive circuit in the order thus terminating the pair of transmission lines, and a resistor is not connected between the pair of transmission lines in remaining video line drive circuits thus opening the pair of transmission lines, and when the voltage inputted to the SELC terminal is at a second voltage level which differs from the first voltage level, a resistor having a resistance value of (n×Ra) is connected between the pair of transmission lines in n pieces of the respective drive circuits thus terminating the pair of transmission lines.

(9) According to one aspect of the present invention, there is provided a display device including: a plurality of pixels; n (n≥2) pieces of video line drive circuits for driving the plurality of pixels; and a display control circuit, wherein an input signal is supplied to the respective video line drive circuits from the display control circuit via a pair of transmission lines in accordance with a differential serial transmission method, each of the video line drive circuits includes an REVS terminal, and when the display control circuit reads a signal from the respective video line drive circuits, only the video line drive circuit where a voltage at a second voltage level is inputted to the REVS terminal transmits the signal to the pair of transmission lines.

(10) According to one aspect of the present invention, there is provided a display device including: a plurality of pixels; n (n≥2) pieces of video line drive circuits for driving the plurality of pixels; and a display control circuit, wherein an input signal is supplied to the respective video line drive circuits from the display control circuit via a pair of transmission lines in accordance with a differential serial transmission method, each of the video line drive circuits includes a resistor, and when the display control circuit reads a signal from the respective video line drive circuits, only the video line drive circuit where reading permitting data is written in the resistor transmits the signal to the pair of transmission lines.

(11) In the display device having the above-mentioned constitution (10), the display control circuit writes the reading permitting data in the resister in the video line drive circuit which is an object to be read next.

DETAILED DESCRIPTION OF THE INVENTION

Hereinafter, embodiments of the present invention are explained in conjunction with drawings.

In all drawings for explaining the embodiments, parts having an identical function are given the same symbol and the repeated explanation of the parts is omitted. Further, the embodiments explained hereinafter do not limit the interpretation of claims of the present invention.

Embodiment 1

Figure 1:
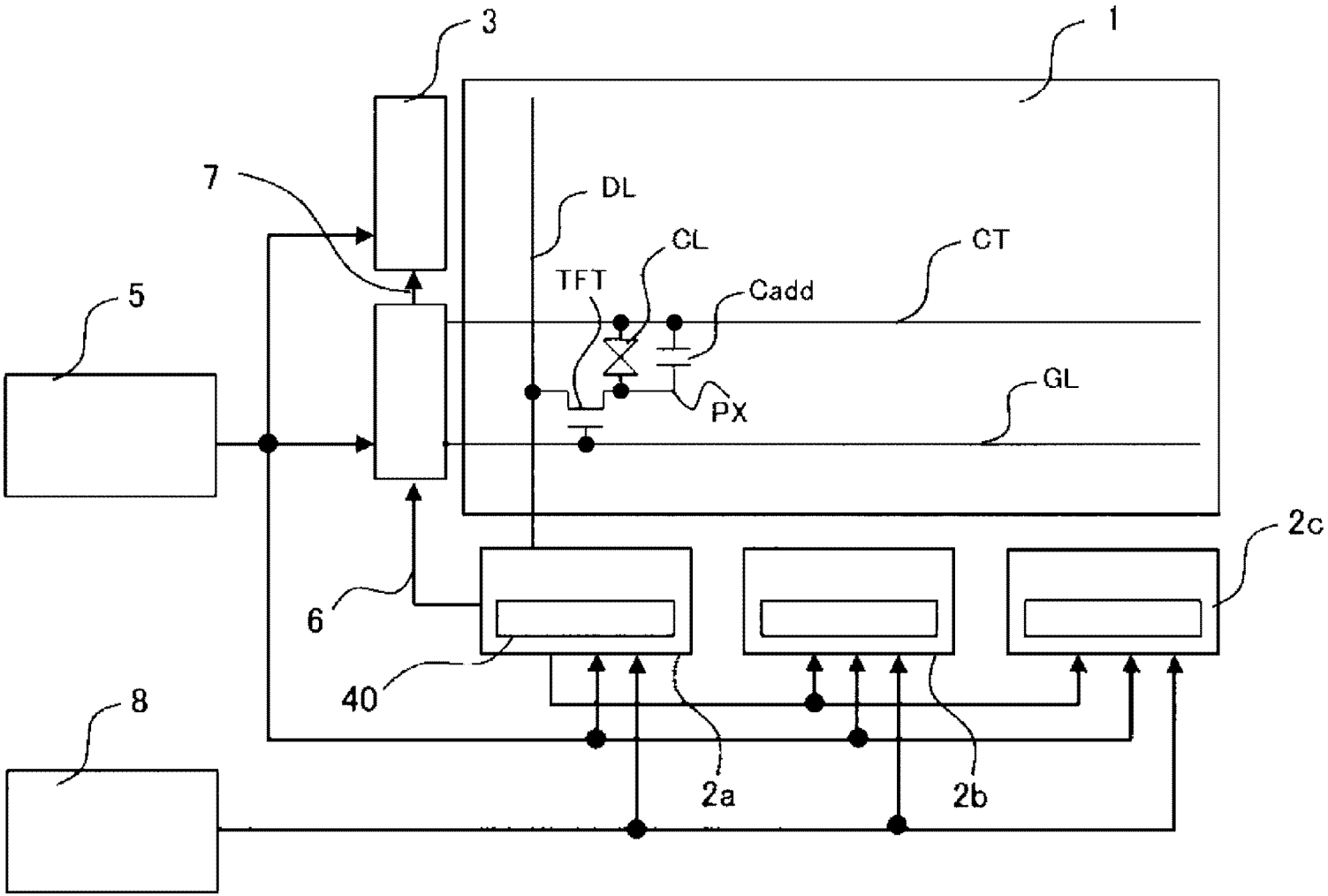
FIG. 1 is a block diagram showing the schematic constitution of a liquid crystal display device according to an embodiment 1 of the present invention.

FIG. 1 is a block diagram showing the schematic constitution of a liquid crystal display device according to an embodiment 1 of the present invention.

The liquid crystal display device of this embodiment is constituted of a liquid crystal display panel 1, a plurality of drain drivers 2, gate drivers 3, and a power source circuit 5. Here, the number of drain drivers 2 is expressed as n (n≥2). FIG. 1 shows the constitution where the number of drain drivers is 3 (n=3) so that the liquid crystal display device includes the drain drivers (2*a* to 2*c*).

The drain drivers (2*a* to 2*c*) and the gate drivers 3 are arranged on a peripheral portion of the liquid crystal display panel 1. For example, the drain drivers (2*a* to 2*c*) and the gate drivers 3 are mounted on the peripheral portions which constitute two sides of a first substrate (for example, a glass substrate) out of a pair of substrates which constitutes the liquid crystal display panel 1 respectively by a COG (Chip On Glass) method. Alternatively, the drain drivers (2*a* to 2*c*) and the gate driver 3 are mounted on flexible printed circuit boards which are arranged on the peripheral portions which constitute two sides of the first substrate of the liquid crystal display panel 1 respectively by a COF (Chip On Film) method.

Further, the power source circuit 5 is mounted on a printed circuit board which is arranged on a peripheral portion of the liquid crystal display panel 1 (for example, a back side of the liquid crystal display device).

In the liquid crystal display device of this embodiment, a display control circuit 40 is incorporated into the respective drain drivers.

The display control circuit 40 converts a display signal inputted from a host computer 8 into an input signal of a display mode by performing timing adjustment suitable for a display of the liquid crystal display panel 1 such as the alternating of data, and inputs the input signal in a display mode to the drain drivers (2*a* to 2*c*) and the gate drivers 3 together with a synchronous signal (clock signal).

The gate drivers 3, under control by the display control circuit 40, sequentially supply a selective scanning voltage to a plurality of scanning lines (also referred to as gate lines; GL). The drain drivers (2*a* to 2*c*) incorporate a video line drive circuit therein, and supplies a video voltage to a plurality of video lines (also referred to as drain lines or source lines; DL) so as to allow the liquid crystal display panel 1 to display an image. The power source circuit 5 generates various kinds of voltages necessary for the liquid crystal display device.

The liquid crystal display panel 1 includes a plurality of sub pixels, and each sub pixel is formed in a region surrounded by the video lines (DL) and the scanning lines (GL).

Each sub pixel includes a thin film transistor (TFT). A first electrode (drain electrode or source electrode) of the TFT is connected to the video line (DL), and a second electrode (the source electrode or the drain electrode) of the TFT is connected to a pixel electrode (PX). Further, a gate electrode of the TFT is connected to the scanning line (GL).

In FIG. 1, symbol CL indicates a liquid crystal capacitance which equivalently indicates a liquid crystal layer arranged between the pixel electrode (PX) and a counter electrode (CT), and symbol Cadd indicates a holding capacitance formed between the pixel electrode (PX) and the counter electrode (CT).

In the liquid crystal display panel 1 shown in FIG. 1, the first electrodes of the TFTs of the respective sub pixels which are arranged in the columnar direction are connected to the video line (DL) respectively. The respective video lines (DL) are connected to the drain drivers (2*a* to 2*c*) which supply video voltages corresponding to display data to the sub pixels arranged in the columnar direction.

Further, the gate electrodes of the TFTs in the respective sub pixels arranged in the row direction are connected to the scanning line (GL) respectively. The respective scanning lines (GL) are connected to the gate drivers 3 which supply scanning voltages (positive or negative bias voltages) to the gates of the TFTs for 1 horizontal scanning time.

In displaying an image on the liquid crystal display panel 1, the gate drivers 3 sequentially selects the scanning lines (GL) from the top to the bottom, for example, and during a selection period of the scanning line, the drain drivers (2*a* to 2*c*) supply video voltages corresponding to display data to the video lines (DL).

Voltages supplied to the video lines (DL) are applied to the pixel electrodes (PX) via the TFTs and, finally, an electric charge is supplied to a holding capacitance (Cadd) and a liquid crystal capacitance (CL) whereby an image is displayed by controlling liquid crystal molecules.

The liquid crystal display panel 1 is configured such that the first substrate on which the pixel electrodes (PX), TFTs and the like are formed and a second substrate on which color filters and the like are formed are made to overlap with each other with a predetermined gap formed therebetween, both substrates are adhered to each other by a sealing material formed in a frame shape in the vicinity of a peripheral portion between both substrates, liquid crystal is filled and sealed in a space between both substrates and inside the seal material through a liquid crystal filling port formed in a portion of the sealing material, and a polarizer is adhered to each outer side of both substrates.

The counter electrode (CT) is mounted on a second substrate side when the liquid crystal display panel is of a TN type or a VA type. When the liquid crystal display panel is of an IPS type, the counter electrode (CT) is mounted on a first substrate side.

The present invention is irrelevant to the inner structure of the liquid crystal panel and hence, the detailed explanation of the inner structure of the liquid crystal display panel is omitted here. Further, the present invention is applicable to a liquid crystal panel having any structure.

In the liquid crystal display device of this embodiment, the display control circuit 40 is incorporated into the respective drain drivers. However, when the display control circuit 40 is incorporated into the respective drain drivers (2*a* to 2*c*), it is necessary to take the synchronization between the display control circuits 40 incorporated into the respective drain drivers. Accordingly, in this embodiment, among the plurality of drain drivers, one drain driver is operated as a master drain driver (the drain driver indicated by 2*a* in FIG. 1), and other drain drivers are operated as slave drain drivers (drain drivers indicated by 2*b*, 2*c* in FIG. 1).

The master drain driver (2*a*) generates a free running dock, and the free running clock generated by the master drain driver (2*a*) is inputted to the slave drain drivers (2*b*, 2*c*). Due to such an operation, both the master drain driver (2*a*) and the slave drain drivers (2*b*, 2*c*) can be operated synchronously.

A gate driver control signal 6 is inputted to the head gate driver 3 from the master drain driver (2*a*), and a gate driver control signal is transferred to the gate driver 3 of a succeeding stage from the head gate driver 3 in response to a gate driver data transfer signal 7.

In this manner, in the liquid crystal display device of this embodiment, by incorporating the display control circuit 40 in the drain drivers (2*a* to 2*c*), the number of parts can be reduced so that a cost can be also reduced.

In this embodiment, a display signal inputted from the host computer 8 arranged outside includes display data, and the input signal which includes the display data is supplied to the drain drivers (2*a* to 2*c*) via the pair of transmission lines from the host computer 8 in accordance with a differential serial transmission system.

Figure 2:
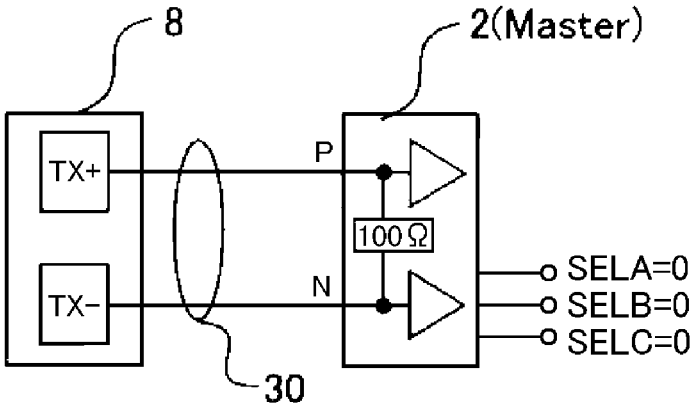
FIG. 2 is a view for explaining terminal setting of a drain driver according to the embodiment 1 of the present invention.
Figure 3:
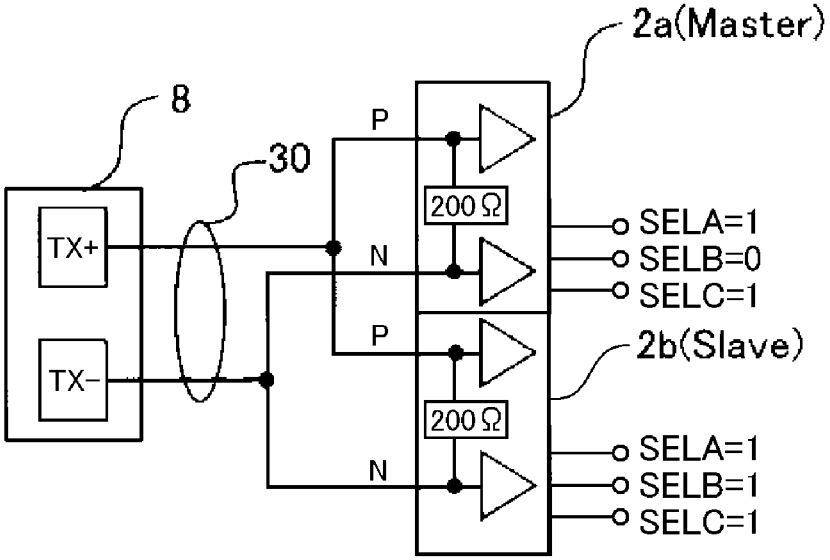
FIG. 3 is a view for explaining terminal setting of the drain driver according to the embodiment 1 of the present invention.
Figure 4:
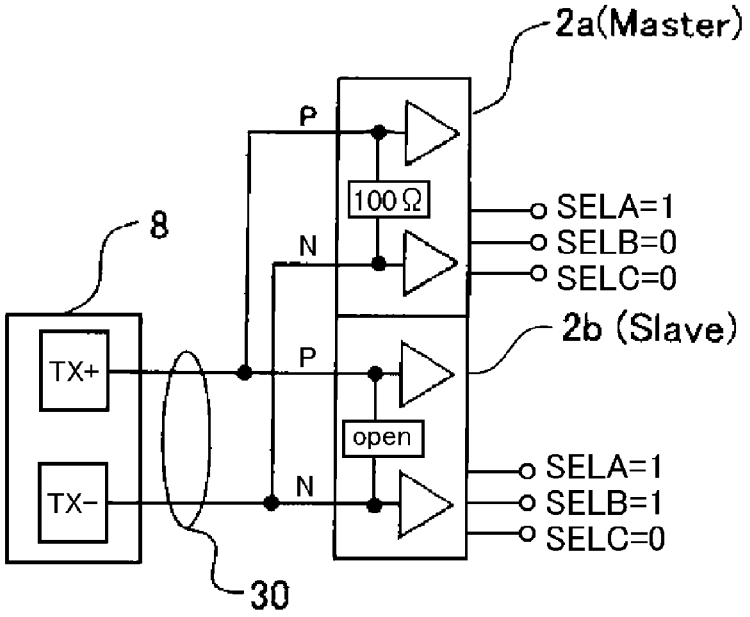
FIG. 4 is a view for explaining terminal setting of the drain driver according to the embodiment 1 of the present invention.

FIG. 2 to FIG. 4 are views for explaining terminal setting of the drain drivers of this embodiment. FIG. 2 to FIG. 4 show the constitutions where the number of drain drivers is 2 (n=2) so that the liquid crystal display device includes two drain drivers (2*a*, 2*b*). In FIG. 2 to FIG. 4 and FIG. 5 described later, only a signal transmission/reception part is shown with respect to the host computer 8 and only a signal reception part is shown with respect to the drain driver 2. Further, in FIG. 2 to FIG. 4 and FIG. 5, symbol TX+ indicates the transmission/reception part on a positive polarity side, symbol TX− indicates the transmission/reception part on a negative polarity side, symbol P indicates the transmission line on a positive polarity side out of the pair of transmission lines 30, and symbol N indicates the transmission line on a negative polarity side out of the pair of transmission lines 30.

As shown in FIG. 2 to FIG. 4, the drain driver of this embodiment is provided with an SELA terminal, an SELB terminal and an SELC terminal.

When a voltage inputted to the SELA terminal is Low (corresponding to a logic value "0", referred to as L level hereinafter), as shown in FIG. 2, the drain driver adopts the 1-chip constitution, while when the voltage inputted to the SELA terminal is High (corresponding to a logic value "1", referred to as H level hereinafter), as shown in FIG. 3 and FIG. 4, the drain driver adopts the plural-chip constitution.

Then, as shown in FIG. 3 and FIG. 4, when a voltage inputted to the SELA terminal is at an H level and a voltage inputted to the SELB terminal is at an L level, the drain driver of this embodiment is operated as the master drain driver (2*a*), while when the voltage inputted to the SELA terminal is at an H level and the voltage inputted to the SELB terminal is at an H level, the drain driver of this embodiment is operated as the slave drain driver (2*b*).

An input signal which includes display data is supplied to the drain driver from the host computer 8 via the pair of transmission lines 30 in accordance with a differential serial transmission system. However, it is necessary to terminate the pair of transmission lines 30 with a terminal resistor. The SELC terminal is provided for setting a method of terminating the pair of transmission lines.

When a voltage inputted to the SELC terminal is at an L level, in the master drain driver (2*a*), a resistor having a resistance value of Ra (100Ω in this embodiment) is connected between the pair of transmission lines 30 thus terminating the pair of transmission lines 30, while in the slave drain driver (2*b*), a resistor is not connected between the pair of transmission lines 30 so that the pair of transmission lines 30 is opened.

In general, in a differential serial transmission system, when line lengths of the pair of transmission lines from the host computer 8 to the respective drain drivers (2*a* to 2*c*) differ from each other, the pair of transmission lines 30 is terminated in the drain driver at the remotest end. FIG. 4 shows such a case.

When a voltage inputted to the SELC terminal is at an H level, in each drain driver (2*a*, 2*b*), a resistor having a resistance value of (n×Ra) (200Ω in this embodiment) is connected between the pair of transmission lines 30 so that the pair of transmission lines 30 is terminated with the terminal resistance. FIG. 3 shows such a case.

The content of the above-mentioned terminal setting is shown in Table 1.

TABLE 1

| terminal | | | built-in terminal | |
|---|---|---|---|---|
| SELA | SELB | SELC | resistance | remarks |
| 0(GND) | 0(GND) | 0(GND) | 100 Ω | one drain drive used, no multidrop |
| 1(Vcc) | 0(GND) | 0(GND)<br>1(Vcc) | 100 Ω<br>200 Ω | plural drain drivers used, setting on master drain driver |
| | 1(Vcc) | 0(GND)<br>1(Vcc) | open<br>200 Ω | two drain drivers used, setting on slave drain driver |

Figure 5:
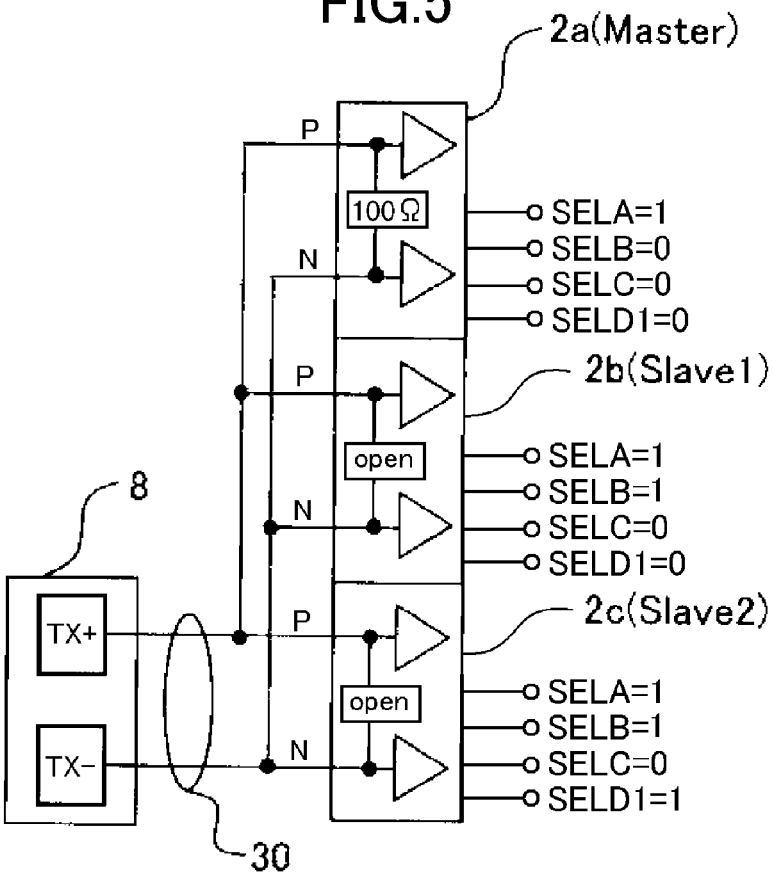
FIG. 5 is a view for explaining terminal setting of the drain driver according to the embodiment 1 of the present invention.

Further, as shown in FIG. 5, when the number of drain drivers (=n) is 3 so that the liquid crystal display device includes the drain drivers (2*a* to 2*c*), there exist two slave drain drivers. In this case, the liquid crystal display device includes a terminal for recognizing whether the slave drain driver is the first slave drain driver or the second slave drain driver. In this embodiment, the liquid crystal display device includes an SELD 1 terminal.

In FIG. 5, a voltage inputted to the SELD1 terminal of the slave drain driver (2*b*) is at an L level and a voltage inputted to the SELD1 terminal of the slave drain driver (2*c*) is at an H level and hence, the slave drain driver (2*b*) per se recognizes that the slave drain driver (2*b*) is the first slave drain driver, and the slave drain driver (2*c*) per se recognizes that the slave drain driver (2*c*) is the second slave drain driver.

Even when the number of slave drain drivers is n (n≥3) or more, in the same manner as the above-mentioned case, (n−2) pieces of terminals ranging from the SELD1 terminal to the SELD (n−2) terminal are provided, a voltage at an H level is inputted to the SELD (j−1) terminal of the jth (2≤j≤n) slave drain driver, and a voltage at an L level is inputted to the SELD (j−1) terminal of other slave drain drivers and hence, each slave drain driver per se can recognize the order thereof among the slave drain drivers.

As has been explained heretofore, according to the present invention, the method of terminating the pair of transmission lines can be changed over by terminal setting.

Further, it is possible to make the drain driver recognize whether the drain driver has the 1-chip constitution or the plural-chip constitution by terminal setting and hence, not only this embodiment can cope with the liquid crystal display panels ranging from low resolution to high resolution using one kind of drain driver but also the 1-chip constitution or the plural-chip constitution can be controlled by the host computer of 1 system and hence, a system on a host computer side can be easily configured.

Further, when this embodiment is applied to a liquid crystal display panel of high resolution class, a length of oblique wiring from the drain drivers to a liquid crystal display panel can be shortened by adopting the plural-chip constitution so that a picture frame can be narrowed.

Embodiment 2

Figure 6:
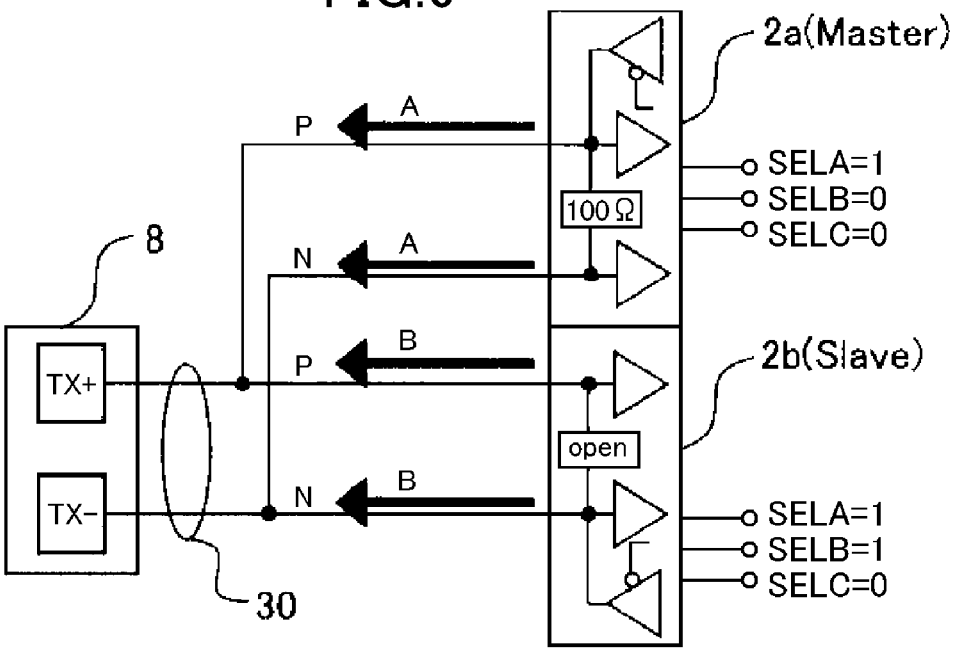
FIG. 6 is a view for explaining a drawback that the liquid crystal display device according to the embodiment 1 of the present invention has.
Figure 7:
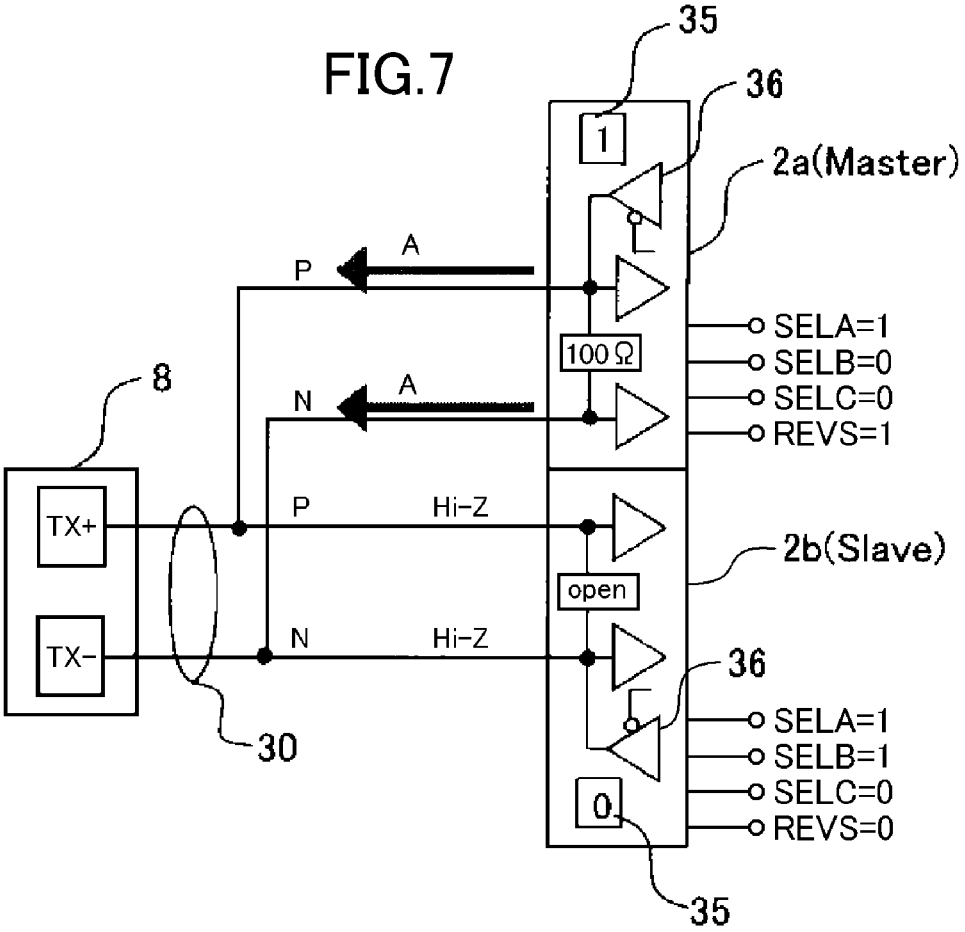
FIG. 7 is a view for explaining terminal setting of a drain driver according to an embodiment 2 of the present invention.
Figure 8:
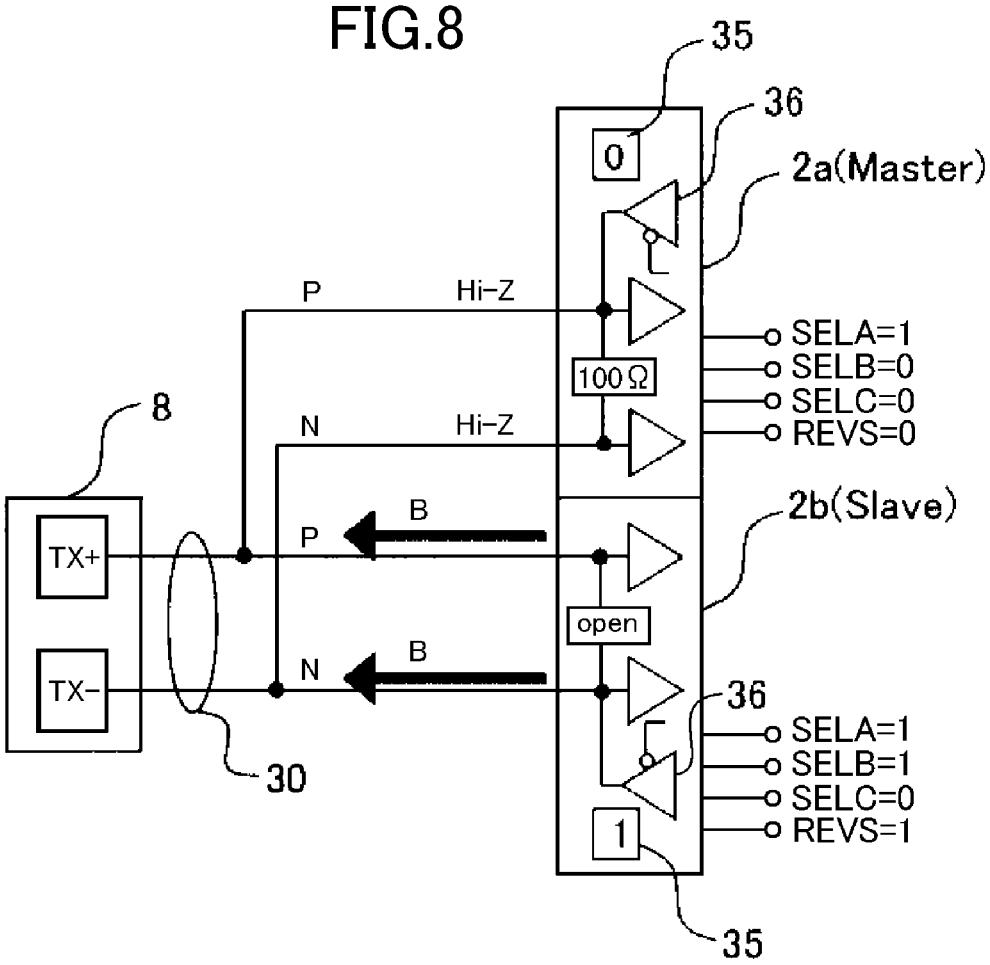
FIG. 8 is a view for explaining terminal setting of the drain driver according to the embodiment 2 of the present invention.

FIG. 6 is a view for explaining a drawback that the liquid crystal display device of the embodiment 1 of the present invention has. In FIG. 6 and FIG. 7 and FIG. 8 described later, only a signal transmission/reception part is shown with respect to a host computer 8 arranged outside and only a signal reception part is shown with respect to the drain driver 2. In FIG. 6 and FIG. 7 and FIG. 8 described later, symbol TX+ indicates the transmission/reception part on a positive polarity side, symbol TX− indicates a transmission/reception part on a negative polarity side, symbol P indicates a transmission line on a positive polarity side out of a pair of transmission lines 30, and symbol N indicates the transmission line on a negative polarity side out of the pair of transmission lines 30. FIG. 6 to FIG. 8 show the constitution where the number of drain drivers is 2 (n=2) so that the liquid crystal display device includes two drain drivers (2*a*, 2*b*).

In the above-mentioned embodiment, at the time of performing reverse transfer (at the time of reading data), that is, when the host computer 8 reads signals from the respective drain drivers (2*a* to 2*c*), there exists a possibility that signals transmitted from a plurality of drain drivers (signal A and signal B in FIG. 6) collide with each other.

Accordingly, in this embodiment, at the time of performing the reverse transfer, the drain driver which is subjected to the reverse transfer is recognized.

FIG. 7 and FIG. 8 are views for explaining the reverse transfer in the liquid crystal display device according to the embodiment 2 of the present invention.

In FIG. 7 and FIG. 8, respective drain drivers (2*a*, 2*b*) are provided with an REVS terminal, and only the selected drain driver transmits a signal to a pair of transmission lines 30 based on a voltage inputted to the REVS terminal.

In FIG. 7, a voltage at an H level is inputted to the REVS terminal of the master drain driver (2*a*), which makes the master drain driver (2*a*) transmit a signal to the pair of transmission lines 30, and a voltage at an L level is inputted to the REVS terminal of the slave drain driver (2*b*), which makes the slave drain driver (2*b*) set an output of a buffer (tri-state buffer) 36 connected to the pair of transmission lines 30 to high impedance (Hi-Z) thus preventing a signal from being transmitted to the pair of transmission lines 30.

In FIG. 8, a voltage at an H level is inputted to the REVS terminal of the slave drain driver (2*b*), which makes the slave drain driver (2*b*) transmit a signal to the pair of transmission lines 30, and a voltage at an L level is inputted to the REVS terminal of the master drain driver (2*a*), which makes the master drain driver (2*a*) set an output of a buffer 36 connected to the pair of transmission lines 30 to high impedance (Hi-Z) thus preventing a signal from being transmitted to the pair of transmission lines 30.

Next, the host computer 8 inputs a voltage at an H level to the REVS terminal of the drain driver which is an object to be read, and inputs a voltage at an L level to other REVS terminals.

Further, a register 35 may be provided in place of providing the REVS terminal to the respective drain drivers (2*a*, 2*b*), and an operation substantially equal to the above-mentioned operation can be performed by making use of the register 35.

That is, reading permitting data (for example, data on "1" of the register 35 of the drain driver (2*a*) in FIG. 7) is written in the register 35 of the drain driver which is an object to be read, and reading non-permitting data (for example, data on "0" of the resistor register 35 of the drain driver (2*b*) in FIG. 7) is written in the register 35 with respect to other drain drivers. The drain driver where reading permitting data is written in the resistor register 35 transmits a signal to the pair of transmission lines 30, while the drain driver where reading non-permitting data is written in the register 35 is configured not to transmit a signal to the pair of transmission lines 30 by setting an output of a buffer 36 connected to the pair of transmission lines 30 to high impedance (Hi-Z).

Embodiment 3

Figure 9:
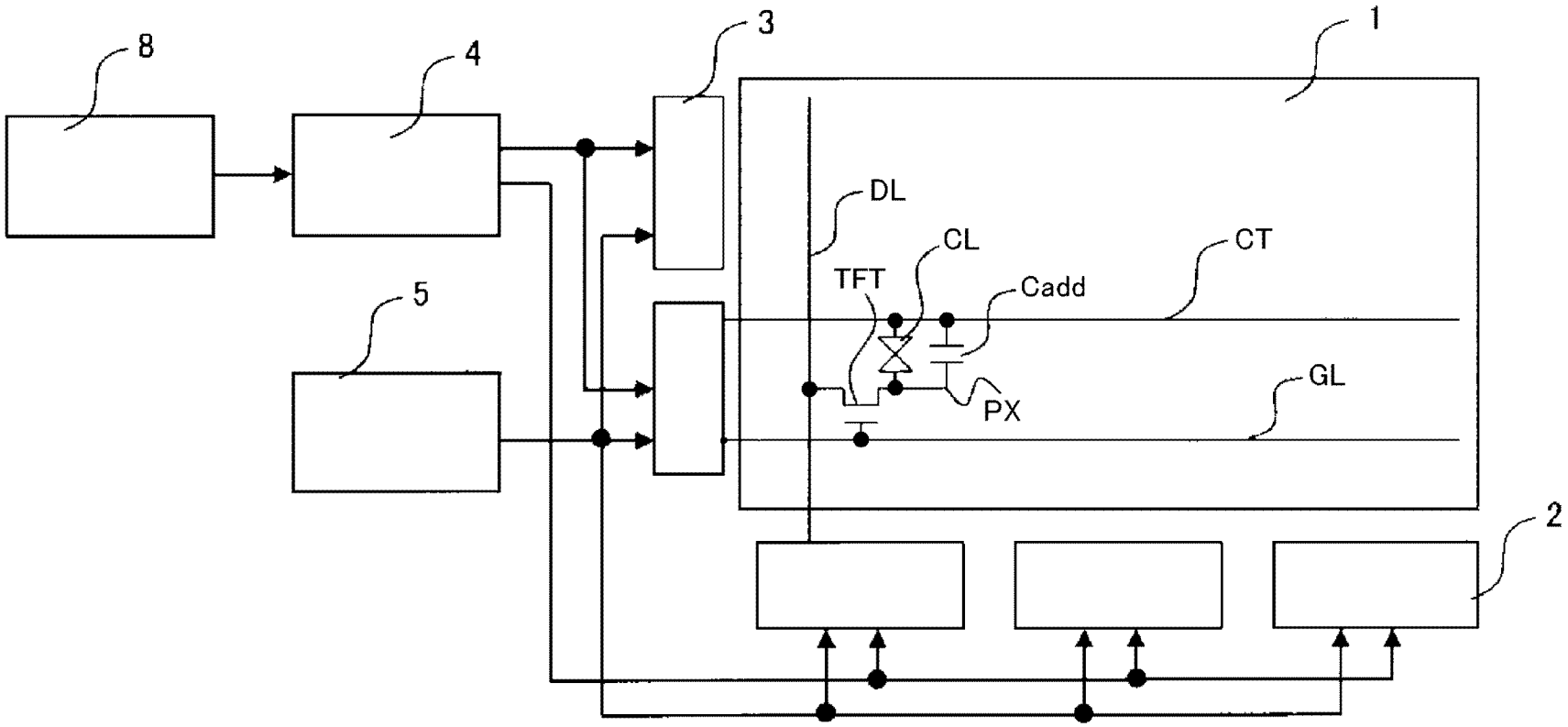
FIG. 9 is a block diagram showing the schematic constitution of a conventional liquid crystal display device.

FIG. 9 is a block diagram showing the schematic constitution of a conventional liquid crystal display device. FIG. 9 shows the constitution where the number of drain drivers is 3 (n=3) so that the liquid crystal display device includes three drain drivers (2*a* to 2*c*).

The liquid crystal display device shown in FIG. 9 is constituted of a liquid crystal display panel 1, drain drivers 2, gate drivers 3, a display control circuit 4, and a power source circuit 5. Here, the display control circuit 4 and the power source circuit 5 are respectively mounted on a printed circuit board which is arranged on a peripheral portion of the liquid crystal display panel 1 (for example, a back side of the liquid crystal display device).

The conventional liquid crystal display device shown in FIG. 9 differs from the liquid crystal display device of the above-mentioned embodiments with respect to a point that the display control circuit 4 is arranged outside the drain drivers 2.

In the liquid crystal display device shown in FIG. 9, considered is a case where the display control circuit 4 supplies display data to the drain drivers 2 in accordance with a differential serial transmission system via a pair of transmission lines.

In such a case, it is possible to apply the technique explained in conjunction with the above-mentioned embodiment 1 to the liquid crystal display device. However, this embodiment does not require the master-slave constitution and hence, each drain driver 2 does not require an SELA terminal, and the drain driver 2 which has an SELB terminal to which a voltage at an L level is inputted becomes the drain driver which is positioned remotest from the display control circuit 4.

Further, in the liquid crystal display device shown in FIG. 9, at the time of performing the reverse transfer, that is, at the time of reading signals from the respective drain drivers (2*a* to 2*c*), the display control circuit 4 may adopt the technique of the above-mentioned embodiment 2.

Although the explanation has been made with respect to the embodiments where the present invention is applied to the liquid crystal display device, it is needless to say that the present invention is not limited to the liquid crystal display device, and the present invention is applicable to display devices in general which have sub pixels such as an organic EL display device, for example.

To briefly explain the advantageous effects acquired by the typical inventions among the inventions disclosed in this specification, they are as follows.

According to the display device of the present invention, by performing the terminal setting, the method of terminating the pair of transmission lines can be changed over or the collision of signals at the time of reading signals via the pair of transmission lines can be prevented.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device comprising:

a plurality of pixels; and n (n≥2) pieces of drive circuits for driving the plurality of pixels, the n pieces of drive circuits being provided in respective chips, wherein display data is supplied to the respective drive circuits from a host computer via a pair of transmission lines in accordance with a differential serial transmission system, the pair of transmission lines include a positive polarity side line and a negative polarity side line and electrically connect with each of the n pieces of drive circuits for supplying the display data mutually, one drive circuit out of the n pieces of drive circuits is operated as a master drive circuit and configured to generate a clock, each drive circuit other than the master drive circuit out of the n pieces of drive circuits is operated as a slave drive circuit and synchronized with the clock, each drive circuit includes an SELC terminal, when a voltage inputted to the SELC terminal is at a first voltage level, a resistor having a resistance value of Ra is connected between the positive polarity side line and the negative polarity side line of the pair of transmission lines in the master drive circuit thus terminating the pair of transmission lines, and a resistor is not connected between the positive polarity side line and the negative polarity side line of the pair of transmission lines in the slave drive circuit thus opening the pair of transmission lines, and when the voltage inputted to the SELC terminal is at a second voltage level which differs from the first voltage level, a resistor having a resistance value of (n×Ra) is connected between the positive polarity side line and the negative polarity side line of the pair of transmission lines in each of the n pieces of drive circuits thus terminating the pair of transmission lines.

2. The display device according to claim 1, wherein each of the drive circuits includes an SELA terminal and an SELB terminal, each of the drive circuits operates as the master drive circuit when a voltage inputted to the SELA terminal is at the second voltage level, and a voltage inputted to the SELB terminal is at the first voltage level, and each of the drive circuits operates as the slave drive circuit when the voltage inputted to the SELA terminal is at the second voltage level, and the voltage inputted to the SELB terminal is at the second voltage level.

3. The display device according to claim 1, wherein when the n is 3 or more, each of the drive circuits includes terminals ranging from an SELD1 terminal to an SELD(n−2) terminal, and each of the slave drive circuits recognizes the order thereof in the slave drive circuits based on levels of voltages inputted to the terminals ranging from the SELD1 terminal to the SELD(n−2) terminal respectively.

4. The display device according to claim 1, wherein each of the drive circuits is a video line drive circuit having a display control circuit.

5. A display device comprising:

a plurality of pixels; and a plurality of drive circuits for driving the plurality of pixels, the plurality of drive circuits being provided in respective chips, wherein an input signal is supplied to each of the drive circuits from a host computer via a pair of transmission lines in accordance with a differential serial transmission system, the pair of transmission lines include a positive polarity side line and a negative polarity side line and electrically connect with each of the plurality of drive circuits for supplying the input signal mutually, each of the drive circuits includes an REVS terminal, and when the host computer reads a signal of the differential serial transmission system from each of the drive circuits, only the drive circuit where a voltage at a first voltage level is inputted to the REVS terminal transmits data to the pair of transmission lines.

6. The display device according to claim 5, wherein each of the drive circuits is a video line drive circuit having a display control circuit.

7. A display device comprising:

a plurality of pixels; and a plurality of drive circuits for driving the plurality of pixels, the plurality of drive circuits being provided in respective chips, wherein an input signal is supplied to each of the drive circuits from a host computer via a pair of transmission lines in accordance with a differential serial transmission system, the pair of transmission lines include a positive polarity side line and a negative polarity side line and electrically connect with each of the n pieces of drive circuits for supplying the input signal mutually, each of the drive circuits includes a register, and when the host computer reads a signal of the differential serial transmission system from each of the drive circuits, only the drive circuit where reading permitting data is written in the register transmits the signal to the pair of transmission lines.

8. The display device according to claim 7, wherein the host computer writes the reading permitting data in the register in the drive circuit which is an object to be read next.

9. The display device according to claim 7, wherein each of the drive circuits is a video line drive circuit having a display control circuit.

10. A display device comprising:

a plurality of pixels;

n(n>2) pieces of video line drive circuits for driving the plurality of pixels, the n pieces of video line drive circuits being provided in respective chips; and a display control circuit, wherein an input signal is supplied to the respective video line drive circuits from the display control circuit via a pair of transmission lines in accordance with a differential serial transmission method, the pair of transmission lines include a positive polarity side line and a negative polarity side line and electrically connect with each of the n pieces of video line drive circuits for supplying the input signal mutually, a first video line drive circuit out of the n pieces of video line drive circuits is operated as a master drive circuit and configured to generate a clock, each video line drive circuit other than the first video line drive circuit out of the n pieces of video line drive circuits is operated as a slave drive circuit and synchronized with the clock, each of the video line drive circuits includes an SELC terminal, when a voltage inputted to the SELC terminal is at a first voltage level, a resistor having a resistance value of Ra is connected between the positive polarity side line and the negative polarity side line of the pair of transmission lines in the first video line drive circuit in the order thus terminating the pair of transmission lines, and a resistor is not connected between the positive polarity side line and the negative polarity side line of the pair of transmission lines in remaining video line drive circuits thus opening the pair of transmission lines, and when the voltage inputted to the SELC terminal is at a second voltage level which differs from the first voltage level, a resistor having a resistance value of (n×Ra) is connected between the positive polarity side line and the negative polarity side line of the pair of transmission lines in the n pieces of the respective drive circuits thus terminating the pair of transmission lines.

11. A display device comprising:

a plurality of pixels;

n(n≥2) pieces of video line drive circuits for driving the plurality of pixels, the n pieces of video line drive circuits being provided in respective chips; and a display control circuit, wherein an input signal is supplied to the respective video line drive circuits from the display control circuit via a pair of transmission lines in accordance with a differential serial transmission method, the pair of transmission lines include a positive polarity side line and a negative polarity side line and electrically connect with each of the n pieces of video line drive circuits for supplying the input signal mutually, each of the video line drive circuits includes an REVS terminal, and when the display control circuit reads a signal of the differential serial transmission method from the respective video line drive circuits, only the video line drive circuit where a voltage at a first voltage level is inputted to the REVS terminal transmits the signal to the pair of transmission lines.

12. A display device comprising:

a plurality of pixels;

n(n≥2) pieces of video line drive circuits for driving the plurality of pixels, the n pieces of video line drive circuits being provided in respective chips; and a display control circuit, wherein an input signal is supplied to the respective video line drive circuits from the display control circuit via a pair of transmission lines in accordance with a differential serial transmission method, the pair of transmission lines include a positive polarity side line and a negative polarity side line and electrically connect with each one of n pieces of video line drive circuits for supplying the input signal mutually, each of the video line drive circuits includes a register, and when the display control circuit reads a signal of the differential serial transmission method from the respective video line drive circuits, only the video line drive circuit where reading permitting data is written in the register transmits the signal to the pair of transmission lines.

13. The display device according to claim 12, wherein the display control circuit writes the reading permitting data in the resister in the video line drive circuit which is an object to be read next.

* * * * *